United States Patent [19]

Galler

[11] 4,018,442

[45] Apr. 19, 1977

[54] SAFETY FRAME FOR WEIGHT LIFTING

[76] Inventor: William J. Galler, c/o Henry Pillard, Diamond K Lane, Joliet, Ill. 60433

[22] Filed: June 23, 1975

[21] Appl. No.: 589,437

[52] U.S. Cl. ..... 272/123

[51] Int. Cl.[2] ..... A63B 13/00

[58] Field of Search ..... 272/81, 84, 79 R, DIG. 4, 272/57 R, 118, 122, 123; 224/5 P, 5 BC, 26 K; 248/27.8; 211/182

[56] References Cited

UNITED STATES PATENTS

| | | | |
|---|---|---|---|
| 2,722,419 | 11/1955 | Tarapczynski | 272/84 |
| 3,370,850 | 2/1968 | Moore | 272/84 |

FOREIGN PATENTS OR APPLICATIONS

| | | | |
|---|---|---|---|
| 952,019 | 4/1949 | France | 224/5 P |

*Primary Examiner*—Richard C. Pinkham
*Assistant Examiner*—William R. Browne

[57] ABSTRACT

The safety frame comprises a rigid, free-standing frame which is held by the hands hanging straight down from the shoulders. The center of gravity of the open space in the center of the frame defined by the frame is occupied by the user and extends through the user's parafrontal plane. The space inside the frame is of sufficient size to provide knee and hip clearance during the entire squatting motion. The lifter's hands grip the frame on either side of the body at points lying in the parafrontal plane and the weights are attached to the frame on either side of the hands, also on points lying in the parafrontal plane, with the weights in close proximity to the user's body.

The frame is rectangular in configuration and includes parallel front and rear bar elements and at least one straight left bar element and at least one straight right bar element extending perpendicular to the parafrontal plane and interconnecting the front and rear bar elements. The right and left bar elements support rods that extend outwardly for support weights. Within the rectangular frame there are two handgripping members with the midpoints thereof being closer to the user than the rods that support the weights. The handgripping members are parallel to the left and right bar elements.

3 Claims, 4 Drawing Figures

FIG. 1
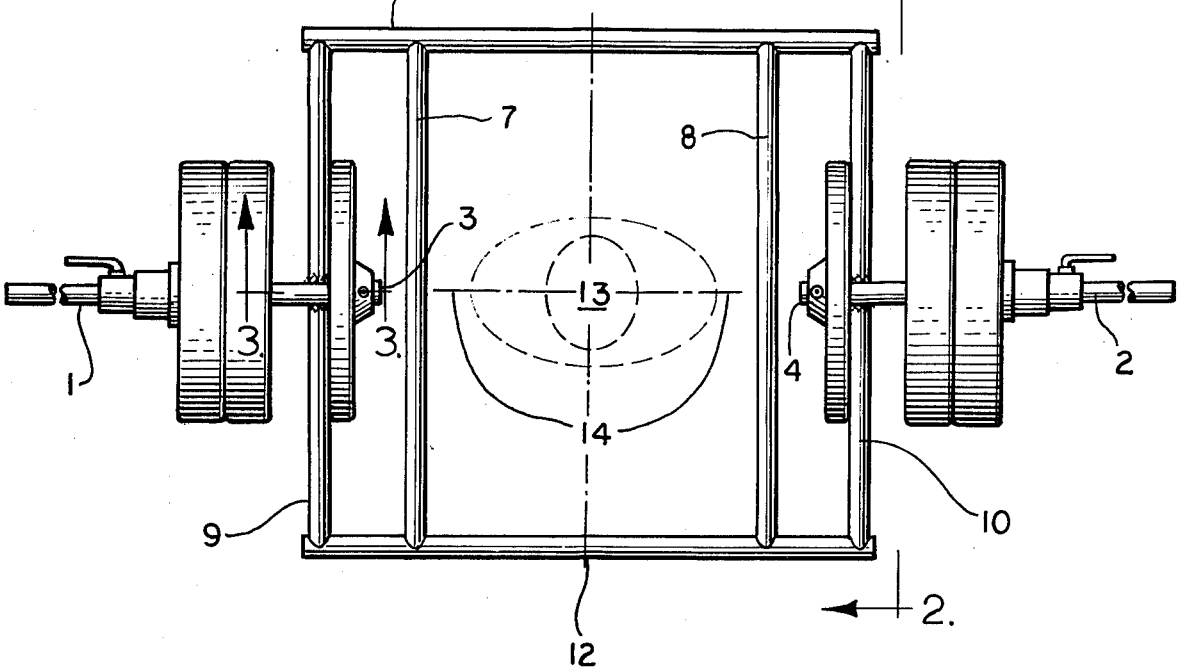
FIG. 3
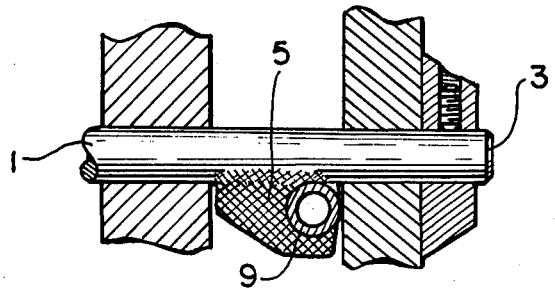
FIG. 2
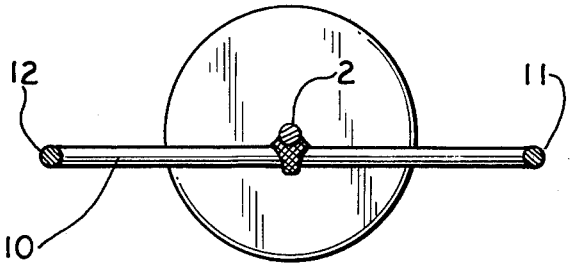
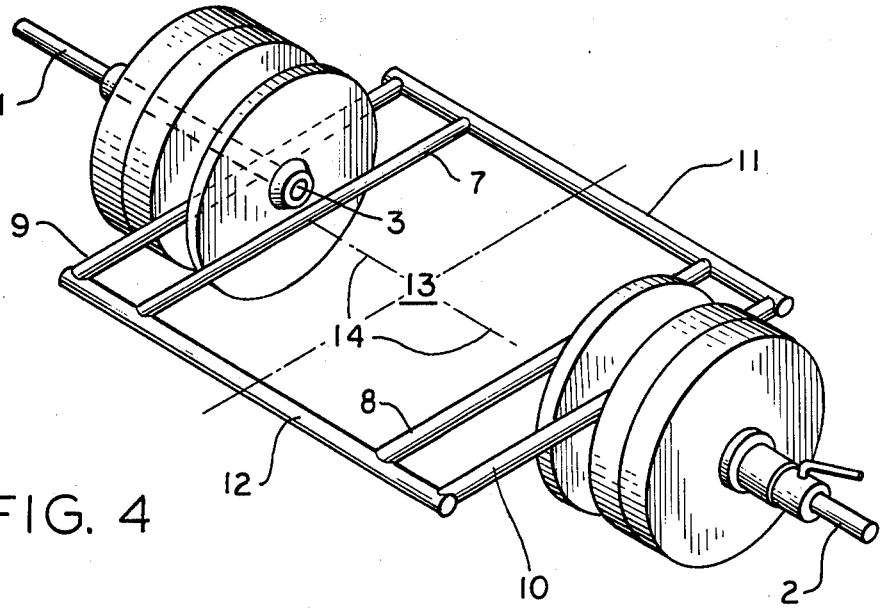
FIG. 4

SAFETY FRAME FOR WEIGHT LIFTING

FIELD OF THE INVENTION

This invention is in the field of weight lifting exercise. It relates to the safety of the lifter during squat-type lifting exercises.

BACKGROUND OF THE INVENTION

The action of squatting and then standing erect is one of the basic human muscular actions, and lifting and jumping movements in many sports depend upon a forceful and efficient performance of the squatting motion. Hence, squatting with a heavy bar bell across the shoulders behind the neck has been one of the most valued training exercises.

However, primarily because the weight is on top of the user, the bar bell squat has the disadvantages of an uncomfortable standing position, danger of injury, the necessity for assistance by others while training, inhibition of effort on the part of the user, and avoidance of the entire exercise by many potential users.

There are in the prior art some devices which are intended for doing squat lifts without the disadvantages of the bar bell squat, but these either have not solved all the problems of squat lifting or have created new ones. Generally, they comprise some method of fastening weighted devices to the body. By fastening weights to the body, of course, this precludes instanteous release of the weights to avoid danger of injury.

SUMMARY OF THE INVENTION

The present invention is embodied in a generally rectangular frame which normally lies in a horizontal plane. The frame has a center of gravity at a point in space which is occupied by the user in performing the squat lifting movement. The weights are secured to the frame in close lateral proximity to the user's body at points which lie in the parafrontal plane to the user when he is properly situated at the center of gravity of the frame. The user grasps the frame at points also lying in his parafrontal plane, which points lie immediately adjacent the points of weight attachment. The device is hand-held and can be released instanteously at any point during the exercise. This encourages strict form without back strain, ease of balancing, and complete safety. Therefore, the need for assistance, inhibitions on the part of the lifter, and a tendency to avoid the exercise, are all eliminated.

BRIEF DESCRIPTION OF THE DRAWING

The invention, including objects and advantages thereof, are illustrated more or less diagrammatically in the drawing, in which:

FIG. 1 is a top plan view of the safety frame device embodying features of the invention, with an outline of the user shown in dotted lines;

FIG. 2 is a view taken along line 2—2 of FIG. 1;

FIG. 3 is a view taken along line 3—3 of FIG 1; and

FIG. 4 is a perspective view of the frame as it rests on the horizontal surface prior to use.

DESCRIPTION OF THE PREFERRED EMBODIMENT

Referring now to the drawing, and particularly to FIGS. 1 and 4, the frame comprises a generally rectangular framework of solid steel bars 7, 8, 9, 10, 11 and 12. What will be termed a front bar 11 and a back bar 12 are interconnected by pairs of side bars 7 and 9 on one side and 8 and 10 on the other side. These bars are welded together in a conventional fashion.

Intermediate the inner side bars 7 and 8, an open space is defined in which the user 13 is shown in dotted lines. The center of gravity 13 of the user should be at the center of the frame with his parafrontal plane extending transversely of the frame along the line 14 which also, as it will be subsequently seen, is the balance line of the safety frame.

Welded to the side bars 9 and 10 on the parafrontal plane and also substantially in the plane of the frame itself are stub bars 1 and 2 for carrying weights. As seen in FIG. 3, the stub bars (only bar 1 is shown) are also welded onto a steel plate fillet 5 which is, in turn, welded to the bars 9 and 10. The purpose of these fillets will be hereinafter discussed.

In using the frame, it is placed on the ground with the exterior bar supports 5 (a support on the opposite side of the frame is not shown) on the underside of the frame. A single weight plate is then attached to each of the exterior bars 1 and 2 on their inwardly extending segments 3 and 4. All of these weights are attached by conventional means.

Additional weight plates are then attached to the outwardly extending segments of the bars 1 and 2, as closely as possible to the frame side bars 9 and 10. The inner weights act as counterbalancing weight plates against the strain of supporting the additional weights attached to the outwardly extending segments of the bars 1 and 2.

The user then steps into the middle of the frame with his feet pointing parallel to the framework bars 7-10. At this time, as the user stands erect before beginning the exercise, the frame's center of gravity 13 and balance line 14 are contiguous with the parafrontal plane of the user's body. The front bar 11 and the back bar 12 are the rigid connecting links between the side bars 7–10. The bars 11 and 12 are parallel to the balance line 14 and equi-distant from it, far enough from it so that the user's bending knees do not bump these bars during the exercise.

The user then squats down and grasps the mid-points of the bars 7 and 8 on the balance line 14. With his back as straight up as possible and head up, holding the frame at arm's length with the arms hanging straight down from the shoulders, the user stands erect, using primarily leg power to push from the squat position to the standing position. Throughout this movement and when the legs are perfectly straight and the user is standing erect, the balance line 14 and the center of gravity 13 of the frame are contiguous with and remain in the user's parafrontal plane and, accordingly, the same plane with the user's center of gravity.

The user can repeat this exercise as many times as desired and when finished, places the bar of frame back on the ground. While repeating the exercise, if at any time the user cannot lift the weighted frame, he simply releases it and steps out of it. The weight is not on top of him so he cannot be crushed underneath it in case he cannot lift it.

If the weight of the loaded frame exceeds the user's gripping strength, lifting straps may be used to reinforce the grip. Straps are wrapped around the user's wrists and the mid-points of the bars 7 and 8 in a manner familiar to weight lifters and can be released in a fraction of a second.

The safety frame provides many advantages over conventional bar bell squat usage. In the conventional relationship, the user is in an uncomfortable standing position with the bar high on the back exerting forward pressure on the spine which makes it impossible to stand completely and comfortably erect. With the present invention, a comfortable, fully erect standing position is possible with easier breathing and much less spinal pressure because the frame is hanging straight down from the shoulders on the same vertical plane as the center of gravity of the body. With conventional devices, the danger of being crushed under the weight if an attempt to come up from a low position fails is always present. With the present invention, there is no danger of being crushed, for when you can't lift the frame, you simply lower it to the ground and let go. With the conventional bar bell there is a tendency to avoid the last maximum effort in a repetition attempt because of the fear of being crushed. Even with spotters, a squat attempt failure is an uncomfortable and possibly dangerous experience. On the other hand, with the present device, the danger of getting crushed is eliminated completely and a maximum effort to the point of muscular failure (an inability to lift the weight) is possible without fear. Furthermore, the athlete can train even in the absence of spotters. With the conventional bar bell there is a danger of knee or back injury from sustained tension in the low position when the weight cannot be lifted. In the present invention, sustained pressure when the squatter is stuck in the low position is usually avoided by quickly releasing the frame so that in a split second any unusual knee, hip or back pain can be relieved. Finally, due to the discomfort and possible danger with conventional devices, many athletes completely avoid squats, and many others perform only partial squats, avoiding the beneficial full movement. With the present device, by eliminating the danger and unnecessary discomfort of the squat, the squat frame encourages athletes to include beneficial, full range squats in their exercise programs.

As would be expected, there are other exercise frames which may be used for squat exercises, but these have one or more substantial disadvantages. In some of them, the weights must necessarily be too far from the body for easy balancing. In most, the frames cannot be released in a split second for maximum safety. In others, the frame is not rigid and is thus prone to swinging movements of its parts which make balance difficult. In still another device, the weight plates are attached to both the front and rear of the body, rather than near the sides on the body's parafrontal plane, whereby balance is extremely difficult because the human body has more lateral stability than forward-backward stability and the weights are farther away from the body's center of gravity and thus harder to control.

Specific ones of these known exercise frames which are within the knowledge of the inventor are the so-called Magic Circle device wherein weight plates are attached on opposite sides of a circular framework in the center of which the user stands. The user supports the weighted circle by means of a non-rigid assembly of chains and straps attached to the user's shoulders. Several of the disadvantages aforelisted are inherent in this device, as will be plainly seen.

Another device is known as a Squat Frame. It is a rectangular frame which consists of gripping bars on either side of the body and bar bell supporting members perpendicular to the gripping bars. These bar bell supporting members are in front and back of the user's body and each has a circular notch to receive and support a standard bar bell from underneath, with the bar bell being under the user, passing between his legs. Others of the substantial disadvantages aforelisted are inherent in this device, as will also be seen.

There is also a patented device, shown in U.S. Pat. No. 3,370,850. This is a rigid frame shaped to fit over the user's shoulders with extending bars on either side of the body upon which weights can be secured. Still others of the disadvantages aforelisted are inherent in this device.

I have now described my invention and the prior art presently extant. It should be understood, however, that my description is not limiting and contemplates other variations. For example, the weights may be attached on vertical bars extending upwardly from the exterior bar segments in my safety squat frame, as long as they are secured and their centers of gravity lie on the parafrontal plane. Other gripping arrangements might be used, such as gripping bars parallel to rather than perpendicular to the user's parafrontal plane. a non-welded construction, using nuts and bolts, might also be employed. Finally, adjustable interior bars which can be fixed at various distances from the external side bars are also within the scope of the invention.

The safety squat frame which has been described is primarily for the purpose of doing squat lifts, as will be understood. However, several other applications of the device are, or would be known to those familiar with weight training, including the standing presses and shoulder shrugs. Both are done more efficiently because the safety frame's center of gravity is on the user's parafrontal plane.

While the embodiment described herein is at present considered to be preferred, it is understood that various modifications and improvements may be made therein, and it is intended to cover in the appended claims all such modifications and improvements as fall within the true spirit and scope of the invention.

I claim:

1. A safety device for use in weightlifting exercise wherein the user squats and rises to lift weights with both hands, said device comprising the following characteristics simultaneously:

a. a rigid, free standing, quadrilaterally symmetrical frame, b. said frame defining an open space of sufficient size so that the user's body can be positioned in it without interferring ring with the frame, and without any part of the frame being above any part of the user's body at any time during the squat exercise, c. said frame is rectangular in configuration and includes front and rear bar elements extending parallel to said parafrontal plane and at least one straight left side bar element and at least one straight right side bar element extending perpindicular to said parafrontal plane and interconnecting said front and rear bar elements, d. said frame having mounted horizontally thereon a left side weight attaching member and a right side weight attaching member, both for the purpose of attaching weights to the frame horizontally, e. said left side weight attaching member and said right side weight attaching member are rigidly fixed to the respective midpoints of said left side bar element and said right side bar element, f. said left and right side weight attaching member extend horizontally out on their respective sides, extending perpendicularly to the left and right side bar elements to which they are fixed, g. said frame further having mounted thereon a left side handgripping member and a right side handgripping member with the midpoints of said handgripping members being closer to the user's body then the weight attaching members, h. said left and right side weight attaching members, the midpoints of said left and right side handgripping members, the midpoints of said straight left and right side bar elements, and the center of gravity of said entire device lying in the parafrontal plane of the user's body when the user is standing fully erect holding the device down at his sides at arms's length, i. when weights are attached to said left and right side weight attaching members, the center of gravity of each of the attached weights will lie in the parafrontal plane of the user's body when the user is standing fully erect holding the device down at his sides at arms's length, j. the center of gravity of said entire device remaining in the same vertical plane as the center of gravity of the user's body during the squatting movement, k. furthermore in the preferred form said left side handgripping member and right side handgripping member are located respectively at midpoints of an inner left side bar element and an inner right side bar element, said inner left and right side bar elements being closer to the user's body than said left and right side bar elements and extending parallel to said left and right side bar elements.

2. The safety device of claim 1 further characterized in that:

a. furthermore in the preferred form the underside of each weight attaching member is reinforced by a plate fillet.

3. The safety device of claim 1 further characterized in that:

a. furthermore in the preferred form the left side weight attaching member is fixed to the said left side bar element such that weight plates can be attached both on the left side and on the right side of said left side bar element, and likewise the right side weight attaching member is fixed to said right side bar element such that weight plates can be attached both on the left side and on the right side of said right side bar element.

* * * * *